United States Patent [19]

Frantzreb, Sr. et al.

[11] 4,174,962

[45] Nov. 20, 1979

[54] FILLED TUBULAR ARTICLE FOR CONTROLLED INSERTION INTO MOLTEN METAL

[75] Inventors: John G. Frantzreb, Sr.; C. David Weiss, both of Peoria, Ill.

[73] Assignee: Caterpillar Tractor Co., Peoria, Ill.

[21] Appl. No.: 900,634

[22] Filed: Apr. 27, 1978

[51] Int. Cl.[2] ..... C22B 9/10

[52] U.S. Cl. ..... 75/53; 75/93 G; 75/129; 75/135

[58] Field of Search ..... 75/53, 93 G, 129, 135

[56] References Cited

U.S. PATENT DOCUMENTS

| | | | |
|---|---|---|---|
| 2,086,756 | 7/1937 | Whitaker | 75/93 G |
| 2,154,613 | 8/1939 | Guthrie | 75/93 G |
| 2,397,418 | 3/1946 | Howard | 75/93 G |
| 3,841,616 | 10/1974 | Rocher | 75/53 |
| 3,934,862 | 1/1976 | LaBate | 75/53 |
| 3,942,775 | 3/1976 | LaBate | 75/53 |
| 4,019,897 | 4/1977 | Yoshida | 75/53 |
| 4,043,798 | 8/1977 | Nashiwa | 75/53 |
| 4,052,202 | 10/1977 | Luyckx | 75/53 |

*Primary Examiner*—Peter D. Rosenberg
*Attorney, Agent, or Firm*—Charles E. Lanchantin, Jr.

[57] ABSTRACT

A filled tubular article includes an elongated metal conduit having a melting temperature above the temperature of a molten metal in which the article is immersed. A core having first and second different and discrete materials is located within the conduit, and the composition is such that the first material controllably treats the molten metal while the second material liquifies and accelerates the liquification of the internal surface of the conduit to promote rapid dissolution thereof.

26 Claims, 6 Drawing Figures

Fig-4-
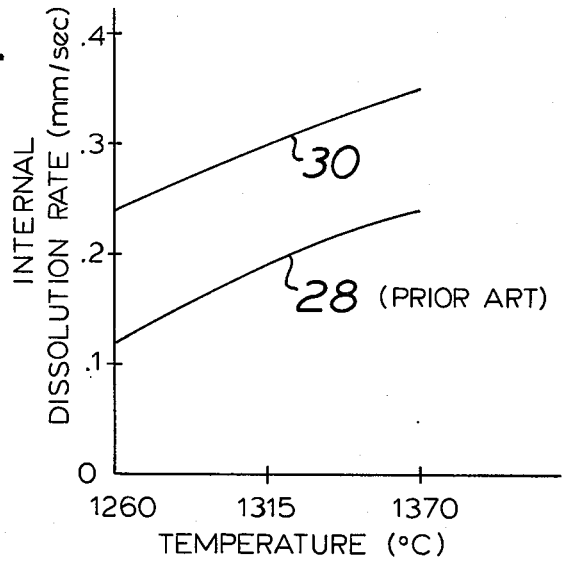
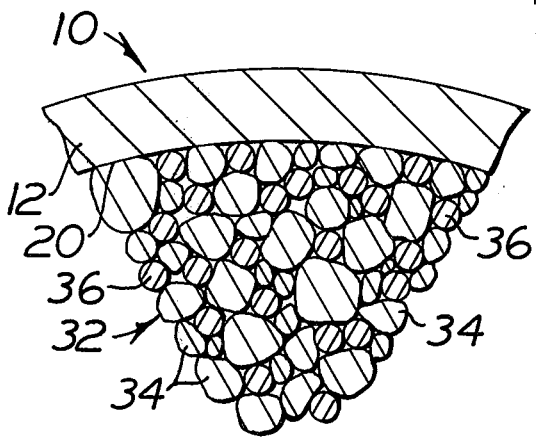
Fig-5-
Fig-6-
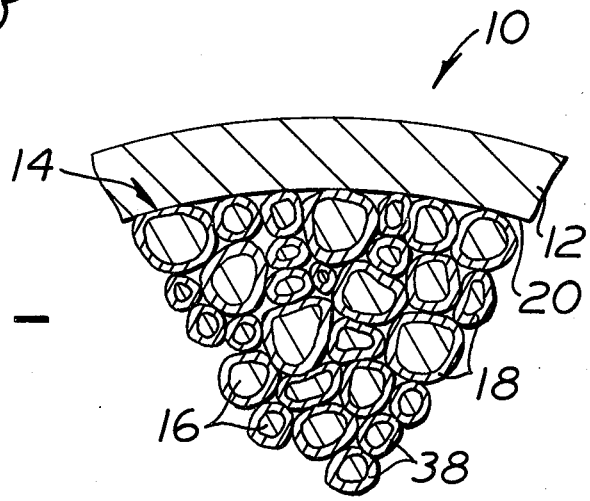

FILLED TUBULAR ARTICLE FOR CONTROLLED INSERTION INTO MOLTEN METAL

BACKGROUND OF THE INVENTION

The present invention relates to a filled tubular article for controlled insertion into a molten metal as it is being cast for altering same.

The addition of alloying and treating agents into a molten metal such as iron by insertion of an elongated rod-like article into a casting mold's downsprue is becoming more well known in the art. More sophisticated equipment has recently been developed to controllably insert such filled tubular articles into the casting mold during metal pouring at precisely the rate and point required to obtain the desired castings with minimum waste.

For the most part, the filled tubular articles are manufactured by depositing powdered ingredients or particulate material onto a strip of metal that may be partly formed into a trough. Thereafter, the strip of metal, which is usually steel because of its formability, is formed into a tube by conventional methods and the tube passed axially through a forming die in order to reduce its external diameter and to compact the powdered ingredients within it. Unfortunately, the thickness of the tubes is greater than that desired for fast dissolution in the molten metal. For example, if attempts are made to make the radial thickness of the tubes below about 0.25 mm (0.010") then the edges of the strip fail to remain in abutment and can allow some of the particulate material to fall out. On the other hand, if the strip edges are overlapped to form the tube, then when the article is inserted into the molten metal the melting rate around its periphery is unequal.

Because of the relatively poor dissolution or melting rate of the relatively thick prior art metal tubes, it has been found necessary to limit the speed at which they are fed to the molten metal in order to prevent the unmelted remaining portions of the tubes from penetrating the sides of the casting mold's downsprue. In some instances this has required that two or more filled tubular articles be simultaneously inserted into the molten metal at additional expense in order to obtain the desired quantity of treating agent or inoculant at the required rate.

We recently recognized that the dissolution rate of a steel tube could be controllably increased by careful selection of the chemical composition of the particulate treating agents within the tube, for example the percentage range of silicon in a ferrosilicon based inoculant, and by controlling the degree of compaction of such agents while maintaining the temperature of the molten metal at a preselected low value. Although the tube would melt faster if exposed to molten metal at a higher temperature, it is desirable to maintain such temperature at a low value in order to avoid waste of energy and to avoid the need for additional inoculants because of the fading characteristics of many treating agents. Tests have indicated that the steel tube can be melted internally to a significant degree by solid state diffusion. Simultaneously, the steel tube dissolves externally as a result of erosion and diffusion upon being exposed to the ingredients of the molten metal, even though the melting temperature of the tube is above the temperature of the molten metal.

Although we believe our solid state diffusion principle noted immediately above is a considerable advancement in the art by recognizing that as much as 30% or more of the thickness of the tube can be dissolved from within the tube, a still faster rate of internal dissolution is desirable in many cases in order to more quickly place the desired amount of treating agent into the molten metal without the tube making contact with the casting mold itself, and to simplify the feeding mechanism required.

In view of the above, it would be advantageous to so construct the filled tubular article that it would have a faster rate of internal dissolution when inserted into a molten metal.

SUMMARY OF THE INVENTION

The present invention is directed to overcoming one or more of the problems as set forth above.

According to the present invention this is accomplished by providing a filled tubular article including an elongated metal conduit having a melting temperature above the temperature of a molten metal in which the article is immersed, and a core intimately contained within the conduit. The core includes first and second different and discrete materials, and the composition of each material is such that the first material treats the molten metal while the second material liquifies and accelerates the liquification of the internal surface of the conduit in order to promote more rapid dissolution of the filled tubular article in the molten metal.

BRIEF DESCRIPTION OF THE DRAWINGS

FIG. 4 is a graph showing the internal dissolution rate of the second embodiment filled tubular article of FIG. 3 in comparison with a prior art filled tubular article after immersion in molten metal at various temperatures.

FIG. 5 is a diagrammatic cross sectional view of a filled tubular article constructed in accordance with a third embodiment of the present invention.

FIG. 6 is a diagrammatic view similar to FIGS. 2 and 5, only showing a filled tubular article constructed in accordance with a fourth embodiment of the present invention.

DETAILED DESCRIPTION

Figure 1:
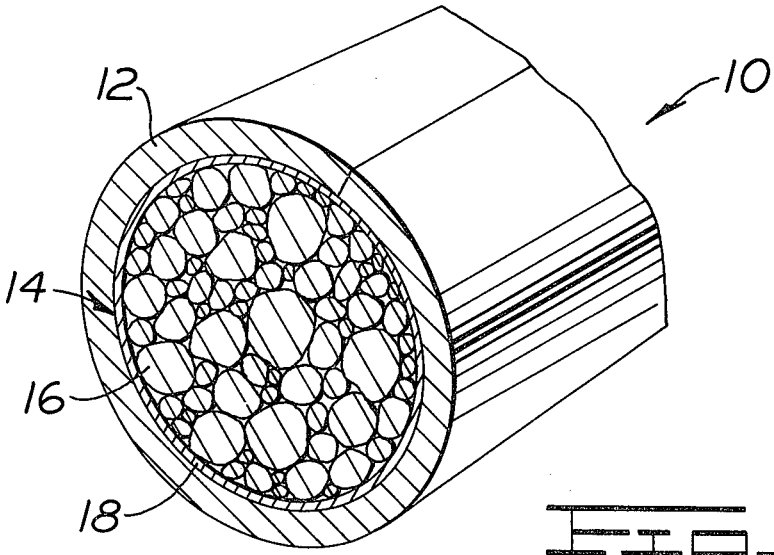
FIG. 1 is a diagrammatic perspective view of a filled tubular article constructed in accordance with an embodiment of the present invention.
Figure 2:
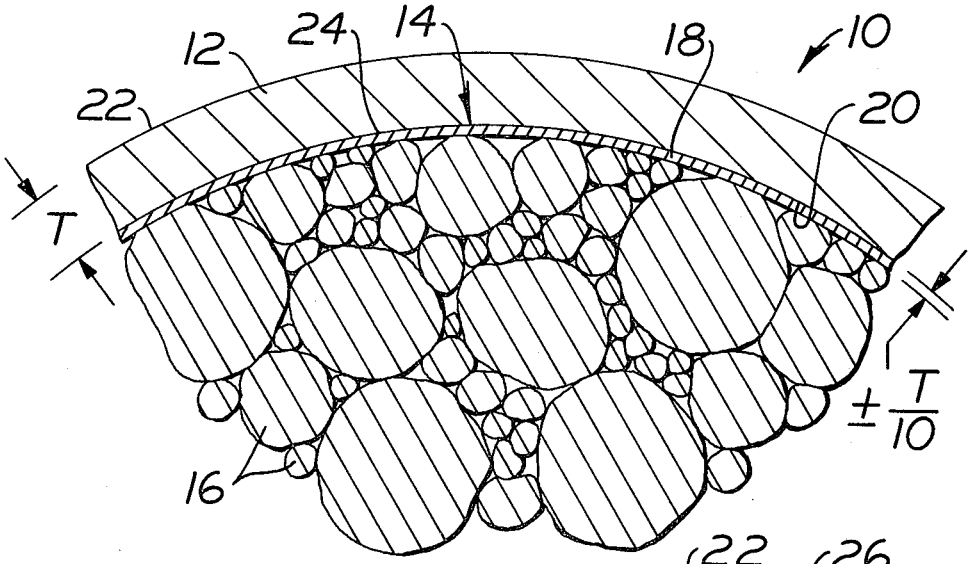
FIG. 2 is a diagrammatic and enlarged fragmentary cross sectional view of the filled tubular article of FIG. 1.

Referring to the embodiment of the invention illustrated in FIGS. 1 and 2, a filled tubular article 10 includes an elongated metal conduit 12 and a core 14 intimately contained within the conduit. Advantageously, the core includes first and second different and discrete materials 16 and 18 in contact with each other.

The metal conduit 12 has an internal surface 20, an external surface 22 and is preferably of ferrous material for reasons of formability, for example, low carbon mild steel having the following composition in percentage by weight:

Mn 0.25–0.50%

C About 0.10%
S About 0.05%
P About 0.01%
Fe Balance

The first material 16 of the core 14 is preferably a relatively compacted particulate treating agent. The term "treating agent" as used herein includes the element or elements which actually alter the molten metal so that upon cooling and hardening thereof into a casting, the casting's metallurgical structure has the desired physical properties. The type of treating agent utilized is dependent upon the base composition of the molten metal to be treated and upon the desired metallurgical characteristics of the solidified casting. For example, for treating iron, the treating agent preferably consists essentially of particulated ferrosilicon capable of passing through a fine mesh sieve such as between Standard Test Sieve Nos. 30 to 140 (0.6 mm to 0.1 mm nominal diameter of the openings). Three examples of such treating agents are set forth below in percentage by weight:

| Example 1 | Example 2 | Example 3 |
|---|---|---|
| Si 74–79% | Si 60–65% | Si 44–48% |
| Al 1.00–1.50% | Mn 5–7% | Mg 8–10% |
| Ca 0.50–1.00% | Zn 5–7% | Fe Balance |
| Fe Balance | Ba 2–3% | |
| | Ca 1.5–2.5% | |
| | Al 0.75–1.25% | |
| | Fe Balance | |

Example 1 above is identified as "Grade 75% ferrosilicon", Example 2 is identified as "SMZ Alloy", and Example 3 is identified as "9% magnesium-ferrosilicon", all of which are manufactured by Union Carbide Corporation, Ferroalloys Division, Buffalo, N.Y. Within each example the individual particles have the same respective alloy composition.

As noted in the above examples, the treating agent 16 normally contains small portions of one or more additional elements in addition to the ferrosilicon constituent such as aluminum, calcium, manganese, zirconium, barium, magnesium, strontium, cerium and the rare earth elements.

We have found it necessary to compact the particulated treating agent 16 within the conduit 12 to a relatively dense state in order to assure rapid internal dissolution of the conduit. For example, the preferred density of the core is equivalent to a degree of compaction in excess of 10% above the tapped density thereof. The term "tapped density" as used herein, refers to the known procedure described in "HANDBOOK OF METAL POWDERS" - Poster, Reinhold Publishing Co., New York, N.Y., 1966, page 57.

The second material 18 of the core 14, on the other hand, is a liquifying agent that preferably has little effect upon the casting's metallurgical structure. In the embodiment of FIGS. 1 and 2, the liquifying agent is a coating or tubular member 24 bonded to the internal surface 20 of the ferrous metal conduit 12. Preferably, the liquifying agent is a material selected from the group consisting of copper, aluminum, phosphorus, sulfur, tin and zinc plus impurities, and alloys of these materials having a melting temperature less than about 1200° C. (2192° F.). Also suitable are alloys containing manganese and boron in combination with one or more of the aforementioned materials of the group having a melting temperature less than about 1200° C. (2192° F.). We contemplate that bronzes, brass and aluminum bronze are suitable liquifying agents. The liquifying agent 18 preferably should have a melting temperature below the melting temperature of the treating agent 16 or alternately must have greater diffusitivity than the treating agent with respect to the material of the conduit 12.

Figure 3:
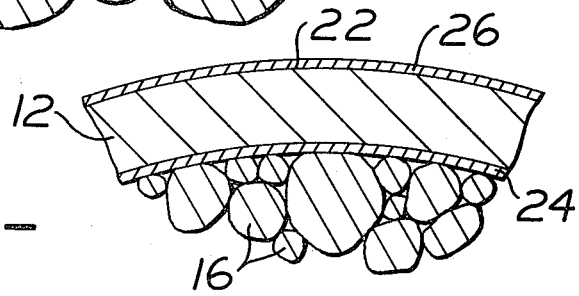
FIG. 3 is a diagrammatic, fragmentary cross sectional view of a filled tubular article constructed in accordance with a second embodiment of the present invention that may be compared with FIG. 2.

A second embodiment of the filled tubular article 10 is illustrated in FIG. 3 and is generally the same as the previously described embodiment, only it differs therefrom by having a liquifying agent or coating 26 bonded to the external surface 22 of the conduit 12 in addition to the internal coating 24. Preferably, the optional coating 26 is of a material selected from the same group as set forth above with respect to the second material 18. The exterior coating 26 can add to the speed of dissolution of the external surface 22 of the conduit 12 when the material of the coating and material of the molten metal in which the conduit is immersed have improved wetability with respct to each other over that of the conduit itself and the molten metal. It should be understood, however, that the external coating must have a melting temperature below the temperature of the molten metal.

In operation, the second embodiment filled tubular article 10 having the aforementioned Grade 75% ferrosilicon treating agent 16, the low carbon mild steel conduit 12, the internal copper coating or cladding 24, and the external copper coating or cladding 26 was dipped for a preselected period of time into a still bath of molten iron at various preselected temperatures below the melting temperature of the conduit. The conduit had a thickness T as indicated in FIG. 2 of 0.38 mm (0.015") with a layer of copper 0.03 mm (0.0012") thick on the outside diameter and a layer of copper 0.05 mm (0.0019") thick on the inside diameter. The melting temperature of the Grade 75% ferrosilicon treating agent was about 1310° C. (2390° F.), and the melting temperature of the copper was about 1080° C. (1975° F.), and even though the melting point of the steel conduit was about 1540° C. (2805° F.) it was determined that the total dissolution rate of the filled tubular article constructed in accordance with the present invention was about 50% greater than a comparison filled tubular article of similar dimensions without either the internal or external copper cladding. In this regard, reference is made to the graph of FIG. 4 showing in the vertical direction the rate of internal dissolution or amount of radial liquification per unit of time of the internal surface 20, of the conduit versus the temperature of the molten iron bath in the horizontal direction. The lower curve 28 represents the internal dissolution rate for dip tests of prior art inoculating articles solely having a steel conduit 12 and a Grade 75% ferrosilicon treating agent, while the upper curve 30 represents dip tests of the second embodiment articles with internal and external copper cladding.

Metallurgical examination of a comparison prior art filled tubular article and the article of the instant invention after the above described dipping procedure indicated that the dissolution mechanism was different for each one. In the second embodiment filled tubular article 10, the austenite grain boundaries of the steel conduit were attacked or penetrated by the liquified copper. The greatly advanced rate of dissolution of the internal surface 20 that was realized was directly attributable to the rapid rate of liquification of the copper and its liquid metal embrittlement attack of the steel conduit. In contrast, the prior art filled tubular articles dissolved internally through a much slower solid state diffusion process.

Referring now to a third embodiment of the present invention as illustrated in FIG. 5, the elongated metal conduit 12 has a core 32 that includes first and second discrete particulate materials 34 and 36 which are thoroughly intermixed and compacted to a density in excess of 10% above the tapped density thereof within the core. The first material 34 is preferably a treating agent similar to the treating agent 16 described above with respect to the first and second embodiments. Preferably also, the second material 36 is similar to those liquifying agents 18 described with respect to the first and second embodiments.

In operation, three different filled tubular articles 10 constructed in accordance with the third embodiment of the present invention and several prior art filled tubular articles for comparison were dipped for preselected periods of time into a still bath of molten iron at various preselected temperatures below the melting temperature of the conduit 12. The conduit in each instance had the same dimensions and was of low carbon mild steel having the previously stated composition and a melting point of about 1540° C. (2805° F.) as previously noted, and in each instance the core was densified to a level in excess of 10% above the tapped density. The composition of the core 32 by weight was varied in order to better determine the dissolution characteristics of each example as follows:

| | Example A | Example B | Example C |
|---|---|---|---|
| Copper Particles | 10.8% | 19.5% | 32.7% |
| Grade 75% Ferrosilicon Particles | 89.2% | 80.5% | 67.3% |

In each of the above three examples the second particulate material or liquifying agent 36 consisted of particles of substantially pure copper capable of passing through a fine mesh sieve such as a No. 200 Sieve (0.075 mm nomimal diameter of the opening), and preferably between a range of Standard Test Sieve Nos. 325 to 400 (0.045 mm to 0.038 mm nominal diameter of the openings). In each of the above three examples also, and in a prior art article which did not have a liquifying agent such as the copper, the previously described Grade 75% ferrosilicon was used as the first particulate material or treating agent 34. The Example A weight proportion or ratio of the liquifying agent 36 to the treating agent 34 was specifically chosen to be similar to that proportion established in the second embodiment utilizing the copper coating 24 within the conduit 12.

It was found through the aforementioned tests that the internal dissolution rate of the Example A third embodiment filled tubular article 10 using 10.8 wt. % copper particles was substantially similar to the second embodiment utilizing the equivalent amount of weight of copper coating. However, the dissolution mechanism was different therebetween. The particulated and thoroughly distributed copper in the third embodiment articles initially liquifies and reacts with the particulate ferrosilicon material to form an intermediate "semi-eutectic" liquid solution of silicon, copper and iron having properties that desirably approaches those of a eutectic liquid solution for rapidly and progressively dissolving or attacking the conduit. Copper forms a low melting eutectic with silicon, for example, and at 16% silicon and 84% copper the melting point is 802° C. (1475° F.). It was further observed that the internal dissolution rates of the Example B and Example C proportions were undesirably less than the Example A embodiments. Therefore, even though the total weight of copper in Example B was twice Example A, there was no commensurate gain in the dissolution rate.

Accordingly, we have concluded that a weight proportion of a liquifying agent 18, such as the copper in either cladding or particulate form, in excess of about 20% relative to the core 14 would not result in a sufficient increase in the internal rate of dissolution of the steel conduit 12 to justify the expense of the excess amount of liquifying agent. Also, adding more than 20% of the liquifying agent could be deleterious to the molten iron. Moreover, any increase in the amount of liquifying agent would necessarily result in distributing a lesser proportion of treating agent 16 to the molten metal at the same feed rate. For these reasons, the proportion of liquifying agent 18 is preferably limited to less than about 15% by weight. On the other hand, we believe that a weight proportion of liquifying agent less than about 5% of the core would result in an insignificant degree of improvement of the internal dissolution rate of the conduit when compared with a prior art filled tubular article.

Referring now to FIG. 6, a fourth embodiment of the instant invention is illustrated, with similar reference numbers being applied thereto to designate elements comparable to those of FIGS. 1, 2, 3 and 5. In FIG. 6, however, the second material or liquifying agent 18 is shown in the form of a coating 38 on the individual particles of the first material or treating agent 16. Specifically, while the coating can be any of the materials listed above with respect to the first embodiment, such coating is preferably a metal coating selected from the group consisting of copper, tin, bronze and brass. For example, a copper coating on the previously described Grade 75% ferrosilicon particles. Such copper coating can be applied to the ferrosilicon particles by a conventional mulling operation. Upon immersing the article 10 of FIG. 6 in molten metal, the coating 38 will quickly liquify and react with the treating agent 16 to initially provide a transitory or intermediate "semi-eutectic" liquid in a manner comparable to the reaction described previously with respect to FIG. 5, which liquid will subsequently dissolve the internal surface 20 of the conduit 12 at a relatively rapid rate.

In view of the foregoing, it is readily apparent that the filled tubular article 10 of the subject invention can be controllably inserted into molten metal for altering same as is disclosed, for example, in more detail in U.S. Pat. No. 3,991,808 issued to John R. Nieman, et al on Nov. 16, 1976. More importantly, however, its rate of feed into the melt can be increased substantially in comparison with prior art articles primarily because of its faster rate of internal dissolution. Such faster rate of internal dissolution is directly attributable to the intimate contact of the chemically discrete materials of the liquifying agent 18 and treating agent 16 within the core. In general, the lower the melting point of the liquifying agent below the preferred maximum melting temperature of the liquifying agent 18 at about 1200° C. (2192° F.), the quicker melting will occur and a liquid-solid reaction will start with the ferrous composition of the conduit. However, it is also to be recognized that the composition of the liquifying agent must not form high melting temperature intermetallic compounds within the tubular article and must be wet or soluble with the ferrous metal of the conduit. Preferably too, the quantity of the treating agent 16 and liquifying agent 18 is restricted to a preselected range as previously noted.

We contemplate that the amount of liquifying agent 18 should be broadly maintained at about 5 to 20% of the total weight of the core 14, and the treating agent should make up the remainder or about 80 to 95% of the weight of the core. Preferably, the amount of liquifying agent should be maintained at about 8 to 15% of the total weight of the core, and specifically at about 10%. Alternately, the thickness of the coating 24 on the inside of the conduit should be about 5% to 15% of a preselected thickness T of the conduit, and preferably about 10% T.

It is important to recognize that in the article 10 of the present invention the treating agent 16 and the liquifying agent 18 not only are in intimate contact but also are discrete chemically, with the liquifying agent promoting a rapid melting of the internal surface of the conduit 12 by either direct action upon the conduit or by forming a low melting point eutectic alloy with the treating agent and subsequent reaction attack of the conduit. This contrasts to prior art use of magnesium and magnesium alloys in a steel conduit that have not promoted a faster rate of internal dissolution of the conduit. For example, magnesium is substantially insoluble in steel and, hence, would not accelerate internal dissolution. Moreover, magnesium and a treating agent have existed heretofore as a reaction product or combined alloy within a steel conduit so that the rate of any reaction attack on the conduit has been minimal. Still further, magnesium often forms undesirable intermetallic compounds in or with the molten metal. On the other hand, the liquifying agent 18 controllably liquifies and accelerates the dissolving of the conduit independent of any substantial degree of alloying influence upon the molten metal.

Other aspects, objects and advantages will become apparent from a study of the specification, drawings and appended claims.

The embodiments of the invention in which an exclusive property or privilege is claimed are defined as follows:

1. A filled tubular article (10) for controlled insertion into a molten metal having a preselected temperature for altering same, comprising:

an elongated metal conduit (12) having an internal surface (20) and a melting temperature above said preselected temperature; and a core (14) having treating agent means (16) of a first material for controllably treating the molten metal and liquifying agent means (18) of a second material different than said first material for liquifying at said preselected temperature and accelerating the dissolving of said internal surface (20) of said conduit (12), said treating agent means (16) and said liquifying agent means (18) being discrete members in intimate contact within said conduit (12) and arranged in preselected proportions by weight.

2. The article (10) of claim 1 wherein said liquifying agent means (18) is present in an amount between 5% and 20% of said core (14) by weight.

3. The article (10) of claim 1 wherein said second material of said liquifying agent means (18) is selected from the group consisting of copper, aluminum, phosophorus, sulfur, tin and zinc plus impurities.

4. The article (10) of claim 1 wherein said second material of said liquifying agent means (18) has a melting temperature less than about 1200° C. (2192° F.).

5. The article (10) of claim 1 wherein said second material of said liquifying agent means (18) is selected from the group consisting of copper, aluminum, phosophorus, sulfur, tin and zinc and alloys thereof having a melting temperature less than about 1200° C. (2192° F.).

6. The article (10) of claim 1 wherein said liquifying agent means (18) is a coating (24) of preselected thickness on said internal surface (20) of the conduit (12).

7. The article (10) of claim 6 wherein said conduit (12) has an external surface (22) and the filled tubular article (10) includes a coating (26) on said external surface (22) of a material having a melting temperature below said preselected temperature.

8. The article (10) of claim 1 wherein said liquifying agent means (18) is a metallic coating (24) on said internal surface (20), said metallic coating (24) being about 5% to 15% of a preselected thickness of said conduit (12).

9. The article (10) of claim 1 wherein said conduit (12) is of ferrous material and said second material of said liquifying agent means (18) is copper.

10. The article (10) of claim 1 wherein said conduit (12) is steel and said liquifying agent means (18) is a layer (24) of said second material bonded to said internal surface (20) of said conduit (12).

11. The article (10) of claim 10 wherein said layer (24) is copper.

12. The article (10) of claim 1 wherein said treating agent means (16) includes a plurality of first particles and said liquifying agent means (18) includes a plurality of second particles, said first and second plurality of particles being intermixed within said conduit (12).

13. The article (10) of claim 12 wherein said first material is ferrosilicon and said second material is copper.

14. The article (10) of claim 1 wherein said treating agent means (16) includes a plurality of particles and said liquifying agent means (18) includes a coating (38) on said particles.

15. The article (10) of claim 14 wherein said first material is ferrosilicon and said second material is copper.

16. The article (10) of claim 14 wherein said coating (38) on said particles is of metal selected from the group consisting of copper, tin, bronze and brass.

17. An improved filled tubular article (10) for controlled insertion into a molten metal having a preselected temperature for altering same, the article (10) being of the type including an elongated metal conduit (12) having an internal surface (20) and a melting temperature above said preselected temperature and including a particulated treating agent (16) therein, the improvement comprising:

discrete means (18) for accelerating the dissolving of a preselected portion of said internal surface (20) of said conduit (12), said discrete means (18) being of a material different than said particulated treating agent (16) and having a melting temperature below said preselected temperature.

18. The article (10) of claim 17 wherein said discrete means (18) is a particulated material intermixed with said particulated treating agent (16) to form a core (14), said particulated material of said discrete means (18) being present in a range of about 5% to 20% by weight and said particulated treating agent (16) being present in a range of about 80% to 95% by weight of said core (14).

19. The article (10) of claim 17 wherein said discrete means (18) is a tubular member (24) located intermediate said internal surface (20) of said conduit (12) and said particulated treating agent (16).

20. The article (10) of claim 19 wherein said conduit (12) has a preselected thickness and said tubular member (24) has a thickness about 10% of said preselected thickness.

21. In combination with a filled tubular article (10) of the type wherein an elongated metal conduit (12) and a particulated treating agent (16) compactly contained therein are provided for immersion in a molten metal at a preselected temperature for altering the molten metal upon cooling and hardening to a preselected metallurgical structure, the improvement comprising:

discrete liquifying agent means (18) for accelerating the rate of internal dissolution of the conduit (12), said discrete liquifying agent means (18) being of a material different than the conduit (12) and the treating agent (16) and selected from the group consisting of copper, aluminum, phosphorus, sulfur, tin and zinc and alloys thereof, having a melting temperature below said preselected temperature, and being present in discrete form within the conduit (12) in a range of from 5% to 20% of the total weight of the discrete liquifying agent means (18) and the treating agent (16) together.

22. The article (10) of claim 21 wherein said discrete liquifying agent means (18) is preferably present in an amount between about 8 and 15% of the total weight of the discrete liquifying agent means (18) and the treating agent (16) together.

23. The article of claim 21 wherein said material has a melting temperature less than about 1200° C. (2192° F.).

24. A filled tubular article (10) for controlled insertion into a molten metal for altering same, comprising:

an elongated metal conduit (12) having an internal surface (20); and a core (14) having a first particulate treating agent means (16) for controllably treating the molten metal and second particulate liquifying agent means (18) for controllably liquifying and accelerating the dissolving of said internal surface (20) of said conduit (12) independent of any substantial degree of alloying influence upon said molten metal, said first and second particulate means (16,18) being intermixed and of chemically discrete materials, and said second particulate means (18) having a melting temperature below the melting temperature of said first particulate means (16).

25. A filled tubular article (10) for controlled insertion into a molten metal for altering same, comprising:

an elongated metal conduit (12) having an internal surface (20); and a core (14) having a first plurality of particles (16) of a construction and material sufficient for controllably treating the molten metal and serving as a treating agent and a second plurality of particles (18) of a construction and material sufficient for controllably liquifying and accelerating the dissolving of said internal surface (20) of said conduit (12) and serving as a liquifying agent, said first and second plurality of particles (16,18) being intermixed, compactly contained within said conduit (12), and of different materials in discrete form, said second plurality of particles (18) making up about 5 to 20% of said core (14) by weight and having a melting temperature less than about 1200° C. (2192° F.).

26. A filled tubular article (10) for controlled insertion into a molten metal for altering same, comprising:

an elongated metal conduit (12) having an internal surface (20); and a core (14) having a first plurality of particles (16) of a construction and material sufficient for controllably treating the molten metal and serving as a treating agent and a second plurality of particles (18) of a construction and material sufficient for controllably liquifying and accelerating the dissolving of said internal surface (20) of said conduit (12), said second plurality of particles being of a material selected from the group consisting of copper, aluminum, phosphorus, sulfur, tin and zinc and alloys thereof including alloys containing manganese and boron in combination with one or more of said materials of said group, said second plurality of particles being present in an amount between 5% and 20% of said core (14) by weight.

* * * * *